US012729940B2

(12) United States Patent
Pope

(10) Patent No.: US 12,729,940 B2
(45) Date of Patent: Sep. 8, 2026

(54) REUSABLE SHELL CASING FOR A RELOADABLE THROWLINE PROJECTIVE LAUNCHER

(71) Applicant: Michael Darren Pope, North Augusta, SC (US)

(72) Inventor: Michael Darren Pope, North Augusta, SC (US)

(73) Assignee: Michael Pope

( * ) Notice: Subject to any disclaimer, the term of this patent is extended or adjusted under 35 U.S.C. 154(b) by 0 days.

(21) Appl. No.: 19/095,787

(22) Filed: Mar. 31, 2025

(65) Prior Publication Data

US 2025/0251226 A1 Aug. 7, 2025

Related U.S. Application Data

(60) Provisional application No. 63/549,129, filed on Feb. 2, 2024.

(51) Int. Cl.

| | |
|---|---|
| ***F42B 12/68*** | (2006.01) |
| ***F42B 5/285*** | (2006.01) |
| ***F42B 5/38*** | (2006.01) |
| ***F42C 19/08*** | (2006.01) |

(52) U.S. Cl.

CPC ..... *F42B 12/68* (2013.01); *F42B 5/285* (2013.01); *F42B 5/38* (2013.01); *F42C 19/083* (2013.01)

(58) Field of Classification Search

CPC .. F42B 5/285; F42B 12/68; F42B 5/26; F42B 5/28; F42B 12/00; F42B 12/02; F42B 12/56; F42C 19/083

USPC ..... 102/446, 447, 504, 530

See application file for complete search history.

(56) References Cited

U.S. PATENT DOCUMENTS

| | | | | | |
|---|---|---|---|---|---|
| 2,469,533 | A | * | 5/1949 | Wellcome | H02G 1/04 102/504 |
| 3,312,168 | A | * | 4/1967 | Gawlick | F42B 3/00 102/470 |
| 3,646,887 | A | * | 3/1972 | Stine | F42B 15/36 446/52 |
| 3,673,963 | A | * | 7/1972 | McGowan | F42B 23/24 102/504 |
| 4,353,304 | A | * | 10/1982 | Hubsch | F42C 19/12 102/470 |
| 4,505,179 | A | * | 3/1985 | Nelson | F42B 12/68 42/105 |
| 4,741,243 | A | * | 5/1988 | Snider | F42B 12/68 102/504 |
| 4,799,906 | A | * | 1/1989 | Perkins, Jr. | F42B 12/68 102/504 |

(Continued)

*Primary Examiner* — James S Bergin

(74) *Attorney, Agent, or Firm* — Dunlap Bennett & Ludwig

(57) ABSTRACT

A reusable breech loaded shell casing for a muzzle loaded throwline projective launcher is disclosed. The reusable breech loaded shell casing has a body defining a combustion chamber, the body extending from a distal end to a proximal end, wherein the proximal end has internal body threading. A primer head movable between an open condition and a sealed condition sealing off the proximal end of the body, wherein the primer head defines a primer chamber for refillably housing a primer propellent. A push cap operatively associable with the distal end of the body, wherein the push cap defines a concavity for seating the muzzle loaded throwline projectile on the breech-loaded chambered reusable shell casing.

9 Claims, 3 Drawing Sheets

(56) References Cited

U.S. PATENT DOCUMENTS

| | | | | |
|---|---|---|---|---|
| 5,831,204 | A * | 11/1998 | Lubben | F42C 19/12 102/318 |
| 7,930,977 | B2 * | 4/2011 | Klein | F42B 7/08 102/447 |
| 7,950,329 | B1 * | 5/2011 | Nemtyshkin | F42B 12/36 102/504 |
| 9,429,386 | B2 * | 8/2016 | Leykin | F41C 9/08 |
| 2024/0060737 | A1 * | 2/2024 | Calvete | F41A 3/66 |
| 2025/0180324 | A1 * | 6/2025 | Peterson | F41A 3/74 |

* cited by examiner

REUSABLE SHELL CASING FOR A RELOADABLE THROWLINE PROJECTIVE LAUNCHER

CROSS REFERENCE TO RELATED APPLICATION

This application claims the benefit of priority of U.S. provisional application No. 63/549,129, filed 2 Feb. 2024, the contents of which are herein incorporated by reference.

BACKGROUND OF THE SUBJECT DISCLOSURE

The present subject disclosure relates to throw line launching systems and, more particularly, to a reusable breech-loaded shell casing adapted for launching reloadable muzzle-loaded throwline projectiles.

When targeting an object to engage a throw line, a throw weight is typically secured to the end of the throw line to aid in the accuracy and predictability of the trajectory of the launched throw line. Typically, shell casings are used for launching the throw weight projectile operatively associated with the throwline to aid in facilitating the desired trajectory; unfortunately, the current state of the art only contemplates single use shell casings. As a result, these devices cannot be reloaded by an end user in the field as current shell casings require press machinery to form a sufficient seal of the high-pressure chamber where the chemical explosive is stored to effectuate propulsion of the throw weight projectile.

Throwline accuracy is of course important, but more critical is having multiple bites at the apple, so to speak, since when casting a throwline, the target is frequently partially obscure, a long distance away, and has obstacles that an errant throwline can easily be caught up on, thwarting the cast or launch. For instance, throwlines are frequently used when targeting trees the user of the throwline wants to engage, say, for uprooting the trees. Even a veteran throwline caster or launcher typically requires many launches to satisfactorily engage the targeted tree since there are normally many tree branches in between the launcher and a 'direct hit'. Many times, the targeted tree is in a forest obstructed by other trees and possibly along uneven terrain, like a gully, where the user cannot access. Accordingly, many launches may be required, and thus the importance of a reloadable throw weight projectile. The prior art, again, only uses throwaway shell casings, and so such shell casings cannot be reused for subsequent reloading of the retrieved throwline and throw weight projectile.

As can be seen, there is a need for a reusable breech-loaded shell casing adapted for launching reloadable muzzle-loaded throwline projectiles, wherein a threaded primer cap that can be screwed and unscrewed with the shell casing to access and seal, respectively, the high-pressure chamber for insertion of propellant therein, whereby after the re-sealed shell casing is breech loaded the reloadable throwline projectile may be muzzle loaded onto the chambered shell casing, thereby enabled repeated re-firing of the throwline projectile in the field.

SUMMARY OF THE SUBJECT DISCLOSURE

The subject disclosure enables the user to reprepare and load a used shell casing used to relaunch a reloadable throwline projectile. The throwline projective is a throw weight having a mass, shape, and structure for facilitating the accuracy of the operatively associated throwline along a targeted trajectory at a desired velocity. And if the last launch was unsuccessful then, in the field, the user can again reprepare the shell casing for firing, reload the shell casing in the breech of the launcher, and then reload the throwline projectile for subsequent launching.

The shell casing provides a threaded primer head adapted to be moved between an open condition and a sealed condition. The open condition provides access to a high-pressure chamber for insertion of propellant. Upon moving the threaded primer head to the sealed condition, a sufficient seal is formed along the accessway to the high-pressure chamber for effective firing of the shell casing, which in turn launches the throwline projectile.

The breech-loaded shell casing may be made of stainless steel and have a bowl-shaped push cap for operatively associating with the reloadable throwline projective loaded thereon by way of a muzzle loading. Upon firing the launcher, the explosion of the propellant sealed in its high-pressure chamber urges the throwline projectile seated on the bowl-shaped cap.

In one aspect of the subject disclosure, a reusable breech loaded shell casing for a muzzle loaded throwline projective launcher provides the following: a body defining a combustion chamber, the body extending from a distal end to a proximal end, wherein the proximal end has internal body threading; a primer head movable between an open condition and a sealed condition sealing off the proximal end of the body, wherein the primer head defines a primer chamber for refillably housing a primer propellent; and a push cap operatively associable with the distal end of the body, wherein the push cap defines a concavity for seating the muzzle loaded throwline projectile on the breech-loaded chambered reusable shell casing.

In another aspect of the subject disclosure, the reusable breech loaded shell casing for a muzzle loaded throwline projective launcher further includes the following: wherein the primer head provides external head threading that engages the internal body threading for moving between the open condition and the sealed condition; a threaded cylinder projecting from a distal surface of a base of the primer head, wherein the threaded cylinder provides the external head threading; a central hole communicating an external environment to the primer chamber, wherein the central opening has internal threading; and an end plug having exterior plug threading configured to move the end plug between an unplugged position and a plugged position sealing off the external environment from the primer chamber; a primer housing projecting from the distal surface of the base of the primer head so as to define the primer chamber, wherein the primer housing has at least one end flash hole and a plurality of sidewall flash holes; a powder cup that seats on the end plug in the plugged position so that the powder cup is within the primer compartment, wherein the primer head provides external head threading that engages the internal body threading for moving between the open condition and the sealed condition; and a threaded cylinder projecting from a distal surface of a base of the primer head, wherein the threaded cylinder provides the external head threading, wherein the end plug provides fastener notches.

These and other features, aspects and advantages of the present subject disclosure will become better understood with reference to the following drawings, description and claims.

DETAILED DESCRIPTION OF THE SUBJECT DISCLOSURE

Figure 1:
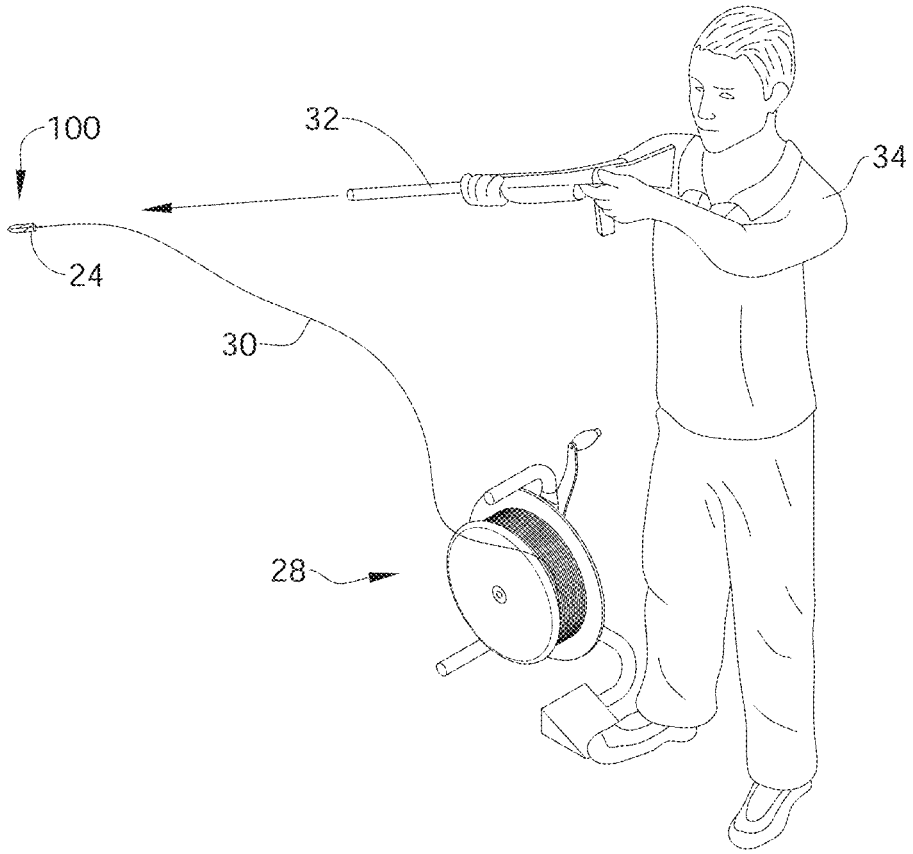
FIG. 1 is a perspective view of an exemplary embodiment of the subject disclosure, shown in use, where a user 34 fires a launching device 32 so that the throwline projectile 100 is shot from the barrel of the launching device 32. The throwline projectile 100 may include a throw weight 24 that is operatively associated with a throwline 30, which in turn is operatively associated with a spool assembly 28 for reeling the throwline back to the user 34.
Figure 2:
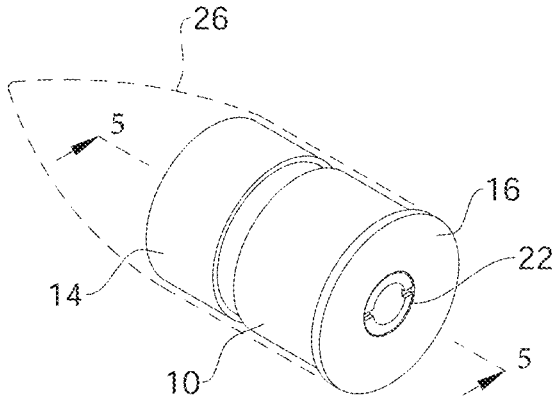
FIG. 2 is a perspective view of an exemplary embodiment of the subject disclosure, illustrating a reusable shell casing 10 assembled in a loadable condition wherein the reusable shell casing 10 is housed with propellant. In some embodiments, but not all embodiments, an exterior forward shell portion 26 may be operatively associated with the reusable shell casing 10.
Figure 3:
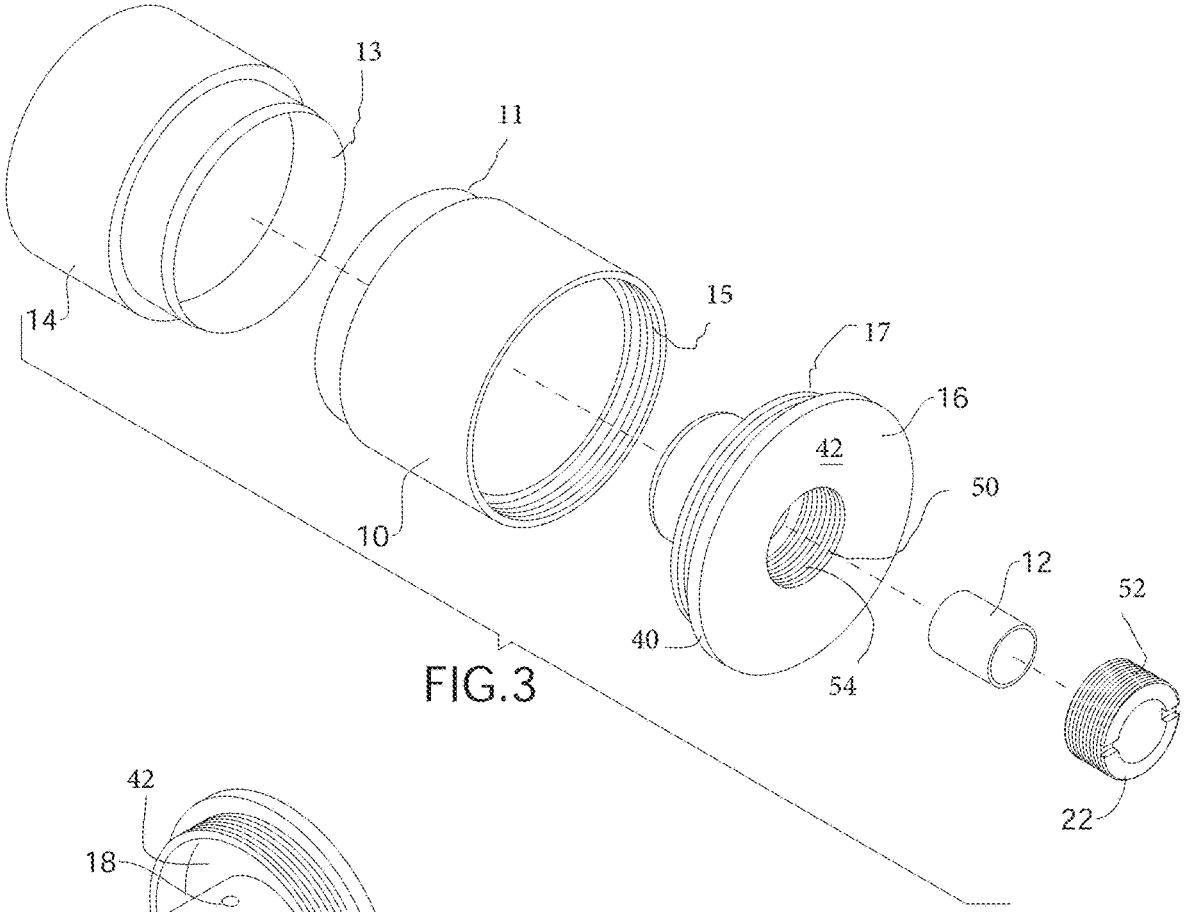
FIG. 3 is an exploded perspective view of an exemplary embodiment of the subject disclosure of the reusable shell casing 10.
Figure 4:
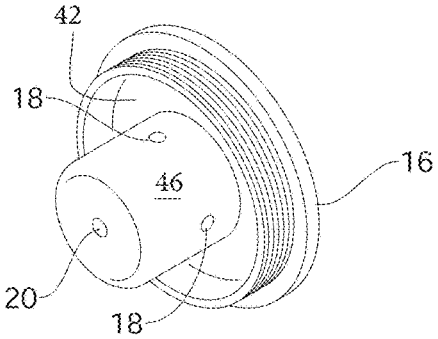
FIG. 4 is a reverse perspective view of an exemplary embodiment of a primer head 16 of the subject disclosure.

The following detailed description is of the best currently contemplated modes of carrying out exemplary embodiments of the subject disclosure. The description is not to be taken in a limiting sense but is made merely for the purpose of illustrating the general principles of the subject disclosure, since the scope of the subject disclosure is best defined by the appended claims.

Referring to FIGS. 1 through 6, the subject disclosure includes a reusable shell casing 10 for launching a throwline projectile 100. The shell casing 10 may be made of stainless steel or other materials that provide sufficient strength, durability, and corrosion-resistance. The shell casing 10 may be dimensioned to be approximately thirty-seven millimeters, though other sizes are also contemplated.

The shell casing 10 may be sandwiched between a distal push cap 14 and a proximal threaded primer head 16. The shell casing 10 may be generally cylindrical and provide a recessed flange 11 along its distal end. The push cap 14 may have a complementary recessed flange 13 dimensioned and adapted to operatively associate with the recessed flange 11 of the shell casing 10. The shell casing 10 may provide female interior threading 15 for operatively associating with the male exterior threading 17 of the threaded primer head 16.

The primer head 16 has a circular base 40 having a proximal side 42 (facing away from the shell casing 10) and a distal side 44 opposite the proximal side 42. From the surface of the distal side 44 a threaded cylinder orthogonally projects. Along an exterior circumferential surface of the threaded cylinder are the male exterior threading 17. The circular base has a central opening 50 that communicates the proximal side and the distal side of the base. Along the inner circumferential walls of the central opening 50 is head internal threading 54. An end plug 22 dimensioned and shaped to occupy the central opening 50 has external threading 52 adapted to form a sufficient firing seal with the interior threading of the central opening 50. The end plug 22 may have fastener notches for facilitating moving the end plug 22 between an unscrewed position to a screwed position closing off the central opening 50.

Figure 5:
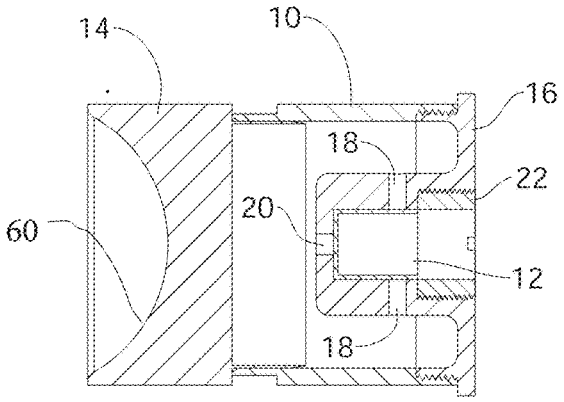
FIG. 5 is a section view taken along line 5-5 in FIG. 2.
Figure 6:
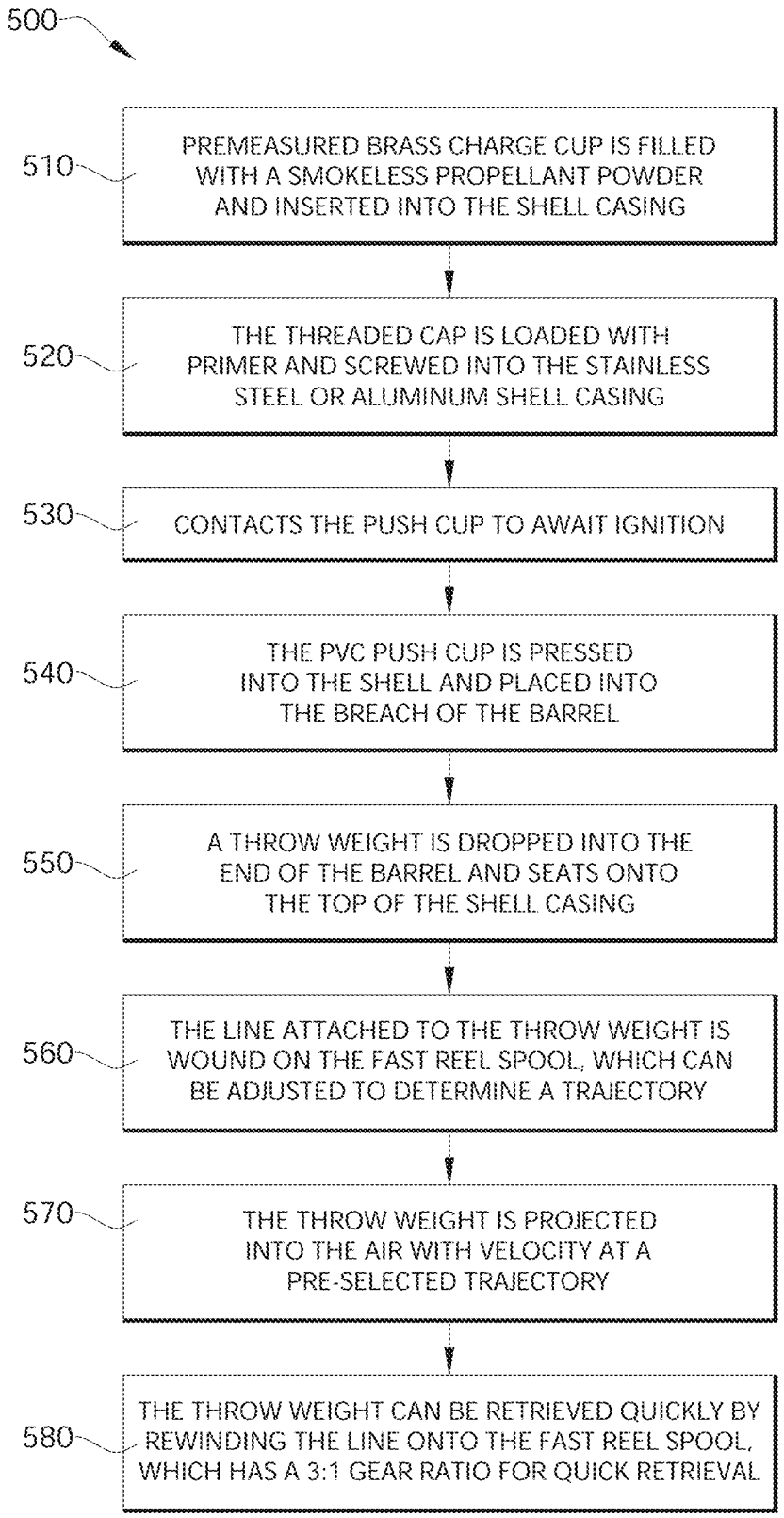
FIG. 6 is a flow chart of an exemplary embodiment of the subject disclosure.

Protruding from an distal surface 42 of the base 40 is primer housing 46 having a distal end flash hole 20 as well as a plurality of side flash holes 18 spaced along the sidewall of the primer housing 46. The primer housing 46 defines a central chamber that receives a powder cup 12. The powder cup 12 is seated on a distal surface of the end plug 22, as illustrated in FIG. 5. The powder cup 12 defines a high-pressure combustion chamber that retains primer propellent (not shown) for igniting for urges the push cap 14 to launch the throwline projectile 100 seated thereon or otherwise operatively associable thereto. The push cap 14 may define a concavity of bowl-shaped for seating the throwline projectile.

The charge cup or powder cup 12 may be filled with smokeless propellant powder and inserted into the central chamber of the primer housing 46 of the threaded primer cap 14 before sealing the end plug 22. Before sealing the end plug 22, the threaded primer head 16 is loaded with primer and screwed into the stainless steel or aluminum shell casing 10. The push cap 14 is then pressed onto the distal flange 11 of the shell casing 10.

The shell casing 10 is breech loaded into the launching device 32 and then the throwline projectile 100 is muzzle loaded to be seated on the push cap 14 of the chambered shell casing 10 or adjacent thereto at the time of firing. Upon firing, the push cap 14 is urged away from the shell casing 10, whereby the push cap 14 pushes the throwline projective 100 out of the barrel of the launcher device 32. The throwline projective 100 projects into the air with velocity at a pre-selected trajectory through the user 34 firing the launcher device 32. An exterior shell 26 may be operatively associated with a distal end of the shell casing 10.

The throwline projectile 100 may include a throw weight 24 with a groove to engage a throwline 3. The throw line 30 may be operatively associated with a spool assembly 28 that is controlled by the user 34. The inventor incorporates by reference the disclosure of U.S. application Ser. No. 18/740,151, which teaches the grooves, throwline association with the projectile 100 and the like.

The subject disclosure can be used in many industries including. Arborist, tree removal, rock climbing, fire rescue, bridge construction, military operations, search and rescue, maritime ship to ship activity and the like.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the subject disclosure and that modifications may be made without departing from the spirit and scope of the subject disclosure as set forth in the following claims.

What is claimed is:

1. A reusable breech loaded shell casing for a muzzle loaded throwline projectile launcher, the reusable breech loaded shell casing comprising:

a body defining a combustion chamber, the body extending from a distal end to a proximal end, wherein the proximal end has internal body threading;

a primer head provides an external head threading that engages the internal body threading for moving between an open condition and a sealed condition sealing off the proximal end of the body, wherein the primer head defines a primer chamber for refillably housing a primer propellent; and a push cap operatively associable with the distal end of the body, wherein the push cap defines a concavity for seating the muzzle loaded throwline projectile on the breech-loaded chambered reusable shell casing.

2. The reusable breech loaded shell casing of claim 1, wherein the primer head provides external head threading that engages the internal body threading for moving between the open condition and the sealed condition.

3. The reusable breech loaded shell casing of claim 1, further comprising a threaded cylinder projecting from a distal surface of a base of the primer head, wherein the threaded cylinder provides the external head threading.

4. The reusable breech loaded shell casing of claim 1, further comprising a central opening communicating an external environment to the primer chamber, wherein the central opening has internal threading; and an end plug having exterior plug threading configured to move the end plug between an unplugged position and a plugged position sealing off the external environment from the primer chamber.

5. The reusable breech loaded shell casing of claim 4, further comprising a primer housing projecting from the distal surface of the base of the primer head so as to define the primer chamber, wherein the primer housing has at least one end flash hole and a plurality of sidewall flash holes.

6. The reusable breech loaded shell casing of claim 5, further comprising a powder cup that seats on the end plug in the plugged position so that the powder cup is within the primer compartment.

7. The reusable breech loaded shell casing of claim 6, wherein the primer head provides external head threading that engages the internal body threading for moving between the open condition and the sealed condition.

8. The reusable breech loaded shell casing of claim 7, further comprising a threaded cylinder projecting from a distal surface of a base of the primer head, wherein the threaded cylinder provides the external head threading.

9. The reusable breech loaded shell casing of claim 8, wherein the end plug provides fastener notches.

* * * * *